United States Patent [19]

Nirei et al.

[11] Patent Number: 4,649,716

[45] Date of Patent: Mar. 17, 1987

[54] AIR CONDITIONER

[75] Inventors: Hironori Nirei; Tsutomu Tamagawa, both of Fuji, Japan

[73] Assignee: Kabushiki Kaisha Toshiba, Kawasaki, Japan

[21] Appl. No.: 802,449

[22] Filed: Nov. 27, 1985

[30] Foreign Application Priority Data

Nov. 28, 1984 [JP] Japan ..... 59-180456[U]

[51] Int. Cl.[4] ..... F25B 47/00

[52] U.S. Cl. ..... 62/280; 62/305

[58] Field of Search ..... 62/280, 281, 262, 507, 62/279, 304, 305

[56] References Cited

U.S. PATENT DOCUMENTS 4,505,129 3/1985 Yamane et al. ..... 62/280

FOREIGN PATENT DOCUMENTS 59-20578 11/1979 Japan .

*Primary Examiner*—Henry Bennett

*Attorney, Agent, or Firm*—Oblon, Fisher, Spivak, McClelland & Maier

[57] ABSTRACT

In an air conditioner, in which drain is sprinkled over a condenser, a bead which abuts the outermost end fin of the condenser is formed in the vertical direction of the end plates to interrupt the gap between the end plates and the outermost end fin.

8 Claims, 4 Drawing Figures

AIR CONDITIONER

FIELD OF THE INVENTION

The present invention relates to an air conditioner and more particularly to an air conditioner of a type in which the drain produced by an evaporator of a window-mount air conditioner is sprinkled over a condenser.

BACKGROUND OF THE INVENTION

In a conventional window-mount air conditioner, the drain condensed by an evaporator has been led to a condenser unit, drawn up by a slinger ring provided on a condenser cooling propeller fan, and sprinkled over a condenser by ventilation of a fan to improve the radiation effect of the condenser.

However, in an air conditioner of this type which has conventionally been employed, there has been a defect that a comparatively wide gap is present in design between the condenser and the end plates which support the side end surface portion of the condenser, and a part of the drain sprinkled over the condenser is scattered outside through this gap.

Further, since the sprinkling is performed by the rotating slinger ring, scattering of the drain from this gap easily occurs at the end peripheral portion of the condenser, resulting in increasing the scattering amount of the drain from the gap of this portion. Under such circumstances, the improvement has especially been desired.

Also, in a conventional air conditioner, the scattering amount of drain to outside is much, and the drain can be used by return resulting in inducing shortage of the sprinkling water amount. Accordingly, a satisfactory radiation effect of the condenser has not been obtained in many cases.

Further, the gap is provided wider (approximately 0.3 mm) than the pitch (usually, approximately, 1.7 mm) of the fins of the condenser from the necessity of mounting the condenser and the end plates, and the ventilation amount and the speed at this portion are greater than those at the gap between the fins. Accordingly, there has been a defect that a great sound due to friction of the outermost end fin of the condenser, end plates or cooling pipes with ventilating air at this gap is produced.

OBJECTS OF THE INVENTION

One of the objects of the present invention is to provide an air conditioner of a structure in which scattering outside of the drain which is sprinkled over a condenser is reduced.

Another object of the present invention is to provide an air conditioner of a structure in which reduction of the radiation effect of a condenser which is caused by shortage of the sprinkled water over the condenser is prevented.

A further object of the present is to provide an air conditioner of a structure in which the friction sound by ventilation to the condenser is reduced.

SUMMARY OF THE INVENTION

To achieve the above objects, in the air conditioner of the present invention, a condenser is constituted of a large number of fins provided between the end plates and the pipes which pass through these fins and the end plate, and a bead so provided is as to abut the outermost end fin of the condenser in the vertical direction of the end plates for interrupting the gap between the end plates and the outermost end fin.

DETAILED DESCRIPTION OF THE PREFERRED EMBODIMENT

Figure 1:
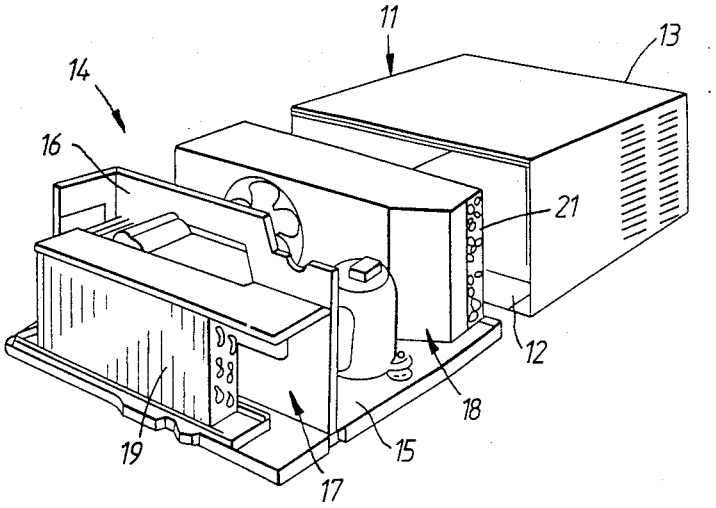
FIG. 1 is a perspective view of the air conditioner of the present invention, in which the cabinet and the main body portion provided therein are shown.

The present invention will now be described in detail with reference to the accompanying drawings, in which like reference numerals and letters are used to designate like or equivalent elements for the sake of simplicity of explanation.

Figure 2:
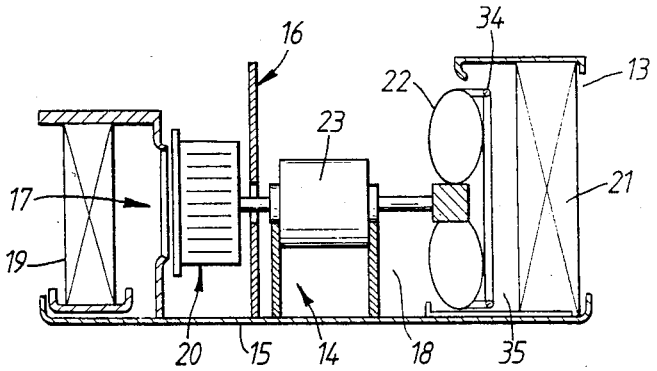
FIG. 2 is a vertical sectional side view of the main body portion of FIG. 1.

Referring now to FIGS. 1 and 2, there are shown an example of an air conditioner according to the present invention. In FIGS. 1 and 2, the numeral 11 shows a cabinet. The front portion 12 and the rear portion of the cabinet 11 are open. In the cabinet 11, the main body structure 14 is slidably inserted from the portion 12. On a bottom plate 15 of the main body structure 14, a partitioning plate 16 is vertically provided to partition the structure 14 into a cooling unit chamber 17 and a condensing unit chamber 18. In the cooling unit chamber 17, an evaporator 19 and a sirocco fan 20 are provided, and in the condensing unit chamber 18, a condenser 21, a propeller fan 22, and a double end motor 23 for driving the propeller fan 22 and the sirocco fan 20 are provided.

Figure 3:
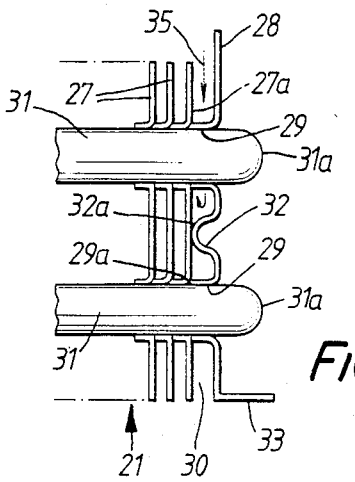
FIG. 3 is a partial cross-sectional plan view of the condenser unit shown in FIGS. 1 and 2.
Figure 4:
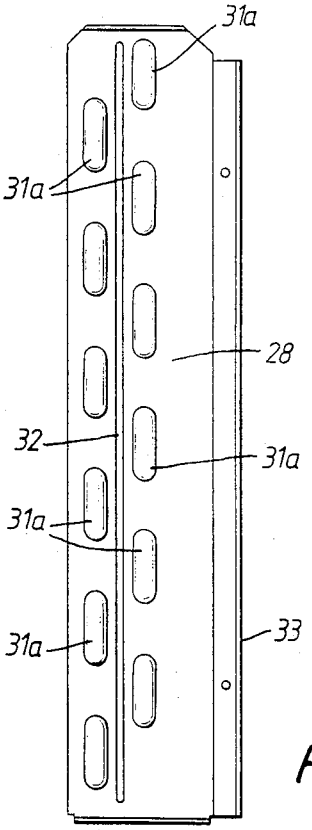
FIG. 4 is a side view of the condenser.

Further explanation of the condenser 21 will be given with reference to FIGS. 3 and 4. The numeral 27 shows the fins provided at a fixed interval, and a side plate 28 is provided outside the outermost end fin **27*a***.

A plurality of cooling medium pipes 31 are inserted through the fins **27*a* and 27. On the side plate 28, pipe insert holes 29 provided by means of a burring process are disposed, and the end surface 29*a* of each hole 29 abuts the outermost end fin 27*a* to form a gap 30 between the fin 27*a* and the side plates 28**.

The cooling medium pipes 31 inserted through the fins 27 and **27*a* are communicated in a single zigzag line by U-shaped pipes 31*a* which pass through the pipe insert holes 29. Further, a bead 32 protruded in the direction of the fin 27*a* is provided vertically on the side plates 28 at the position between the pipe insert holes 29 arranged right and left. The end 32*a* of the bead 32 contacts the outermost end fin 27*a* to interrupt the gap 30. The numeral 33 shows a mounting piece for fixing the condenser 21 formed on the side plates 28 to the bottom plate 15**.

On the propeller fan 22 faced to the condenser 21, a slinger ring 34 is mounted. It is designed to draw up and scatter the drain 35 collected on the bottom plate 15 and sprinkle it over the condenser 21 to promote condensation. Namely, wind is sent to the condenser 21 by rotation of the propeller fan 22, and simultaneously the drain 35 is scattered by the slinger ring 34. The scattered drain 35 is sprinkled over the condenser by the ventilating force of the propeller fan 22. A part of the drain 35 is directed to the gap 30 between the fin **27*a*** and the end plates 28, but the gap 30 is interrupted by the bead 32. Accordingly, the drain 35 does not run out through the gap 30. Also air does not pass through the gap 30, and no abnormal sound due to air passing through the pipe insert holes 29 is produced.

In the above embodiment of the present invention, a single bead 32 is provided on the side plates 28, but beads may be provided in two or three rows depending on the size of the condenser 21. The main object of the present invention for preventing scattering of the drain 35 by a single bead on the propeller fan 22 side can be achieved, but the beads in two or three rows have the same effect regarding the leak of the leaked component which can not be prevented by the bead 32 in the first row and further, can improve the mechanical strength of the side end plates 28.

As explained above, according to the present invention, scattering outside of the drain sprinkled over the condenser can be reduced and also a sound due to friction of ventilating air can be reduced. Further, the rigidity of the end plates is improved by the bead, and the durability can be improved. Accordingly, the thickness of the end plates can be thinned correspondingly.

What is claimed is:

1. An air conditioner comprising:

(a) a cabinet having an interior;

(b) a partitioning plate vertically mounted in the interior of said cabinet so as to divide the interior of said cabinet into a cooling unit chamber and a condenssing unit chamber;

(c) an evaporator mounted in said cooling unit chamber;

(d) a first fan mounted in said cooling unit chamber in position to blow air on said evaporator;

(e) a condenser mounted in said condensing unit chamber, said condenser comprising:

(i) at least one side plate having at least two parallel vertical rows of pipe insert holes therethrough;

(ii) a plurality of fins extending in parallel to each other and in parallel to said at least one side plate, said plurality of fins including an outermost end fin which is the one of said plurality of fins adjacent to said at least one side plate, said outermost end fin being spaced from said at least one side plate by a gap; and (iii) a plurality of cooling medium pipes, each one of said plurality of cooling medium pipes extending through a first set of corresponding holes in said plurality of fins, extending through a first one of said pipe insert holes, doubling back in a U-shape, extending through a second one of said pipe insert holes in the same one of said at least two parallel vertical rows of pipe insert holes, and extending through a second set of corresponding holes in said plurality of fins, (iv) said at least one side plate being formed with at least one vertically extending bead extending inwardly so that the inner surface of said bead makes at least linear contact with said outermost end fin, preventing passage of drain or air through said gap;

(f) a second fan mounted in said condensing unit chamber in position to blow air on said condenser;

(g) a motor mounted in the interior of said cabinet and operatively connected to said second fan; and (h) a slinger ring mounted on said second fan in position to draw up drain in said condensing unit chamber and to scatter the drain on said condenser to promote condensation.

2. An air conditioner as recited in claim 1 wherein said first fan is a sirocco fan.

3. An air conditioner as recited in claim 1 wherein said second fan is a propeller fan.

4. An air conditioner as recited in claim 1 wherein said motor is mounted in said condensing unit chamber.

5. An air conditioner as recited in claim 1 wherein:

(a) said partitioning plate is mounted on a bottom plate and (b) said bottom plate is slidably mounted in the interior of said cabinet.

6. An air conditioner as recited in claim 1 wherein:

(a) said pipe inserted holes are burred inwardly and (b) the inwardly extending burrs of said pipe insert holes abut said outermost end fin.

7. An air conditioner as recited in claim 1 wherein said at least one vertically extending seal is located between said at least two parallel vertical rows of pipe insert holes.

8. An air conditioner as recited in claim 1 wherein said motor is also operatively connected to said first fan.

* * * * *